United States Patent [19]

Farnworth et al.

[11] Patent Number: 4,843,664

[45] Date of Patent: Jul. 4, 1989

[54] EXPANDING INSULATING PAD

[75] Inventors: Brian Farnworth, Kinburn; Randall J. Osczevski, Nepean, both of Canada

[73] Assignee: Her Majesty the Queen in right of Canada, as represented by the Minister of National Defense, Canada

[21] Appl. No.: 120,374

[22] Filed: Nov. 13, 1987

[30] Foreign Application Priority Data

Aug. 20, 1987 [CA] Canada ..... 545021

[51] Int. Cl.[4] ..... A47G 9/06

[52] U.S. Cl. ..... 5/417; 5/473; 5/487; 428/118

[58] Field of Search ..... 428/116, 118, 73; 5/417–420, 473, 487, 400, 195, 182

[56] References Cited

U.S. PATENT DOCUMENTS

| | | | |
|---|---|---|---|
| 317,922 | 5/1885 | Bulkeley et al. | 5/202 |
| 2,553,765 | 5/1951 | Higgins et al. | 5/481 |
| 2,608,502 | 8/1952 | Merriman | 428/116 |
| 2,697,231 | 12/1954 | Strand | 428/116 |
| 2,728,479 | 12/1955 | Wheeler | 428/116 |
| 2,848,132 | 8/1958 | Davous | 428/116 |
| 2,954,074 | 9/1960 | Meyerhardt | 5/481 |
| 3,000,020 | 9/1961 | Lombard et al. | 428/118 |
| 3,018,205 | 1/1962 | Barut | 428/116 |
| 3,059,251 | 10/1962 | Pollock | 5/481 |
| 3,087,607 | 4/1963 | Robinson | 428/116 |
| 3,101,652 | 8/1963 | Imielinski | 428/73 |
| 3,134,705 | 5/1964 | Moeller | 428/116 |
| 3,197,357 | 7/1965 | Schulpen | 5/481 |
| 3,306,513 | 2/1967 | Fishman | 428/116 |
| 3,405,659 | 10/1968 | Hees | 428/116 |
| 3,526,912 | 9/1970 | Lerman | 5/481 |
| 3,556,917 | 1/1971 | Eakin et al. | 428/118 |
| 3,761,974 | 10/1973 | Kuss | 5/401 |
| 3,814,030 | 6/1974 | Morgan | 5/417 |
| 4,224,705 | 9/1980 | Santo | 5/400 |
| 4,336,292 | 6/1982 | Blair | 428/116 |
| 4,370,767 | 1/1983 | Fraser | 5/417 |
| 4,500,583 | 2/1985 | Naul | 428/116 |
| 4,550,046 | 10/1985 | Miller | 428/116 |
| 4,585,381 | 4/1986 | Boyse | 428/116 |
| 4,641,726 | 2/1987 | Fearon et al. | 428/116 |

FOREIGN PATENT DOCUMENTS

| | | | |
|---|---|---|---|
| 191612 | 7/1919 | Canada | 5/434 |
| 866094 | 3/1971 | Canada | 5/434 |
| 0014281 | 8/1980 | European Pat. Off. | 5/434 |
| 1140278 | 7/1957 | France | 5/481 |
| 1372493 | 8/1964 | France | 5/481 |
| 926720 | 5/1963 | United Kingdom | 297/DIG. 1 |
| 952001 | 3/1964 | United Kingdom | 297/DIG. 1 |

*Primary Examiner*—Alexander Grosz
*Assistant Examiner*—Eric K. Nicholson
*Attorney, Agent, or Firm*—Stevens, Davis, Miller & Mosher

[57] ABSTRACT

The invention disclosed is a portable thermally insulating mattress. The mattress comprises body support means and waterproof enclosure means. The body support means is in the form of a honeycomb structure which is incompressible in a vertical direction under body weight, while being compressible in a horizontal direction to facilitate packing. The cells of the honeycomb structure are sized to balance the heat loss by radiation with the heat gain by conduction by the air in the cells, i.e. 5–15 mm mean diameter for a 5 cm thick mattress.

7 Claims, 1 Drawing Sheet

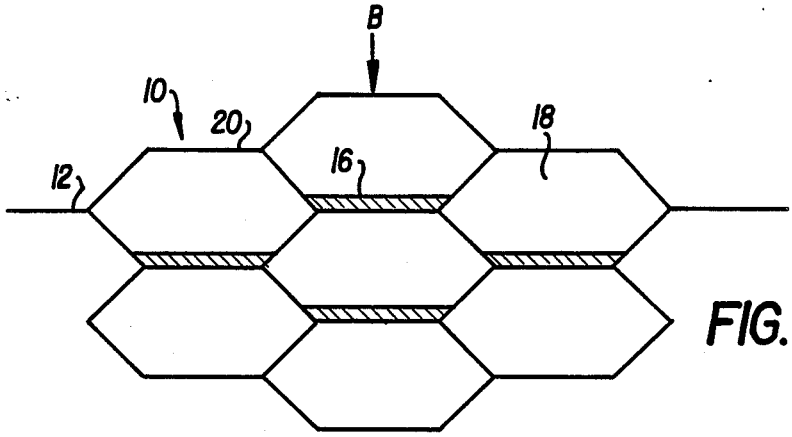
FIG. 1
FIG. 2
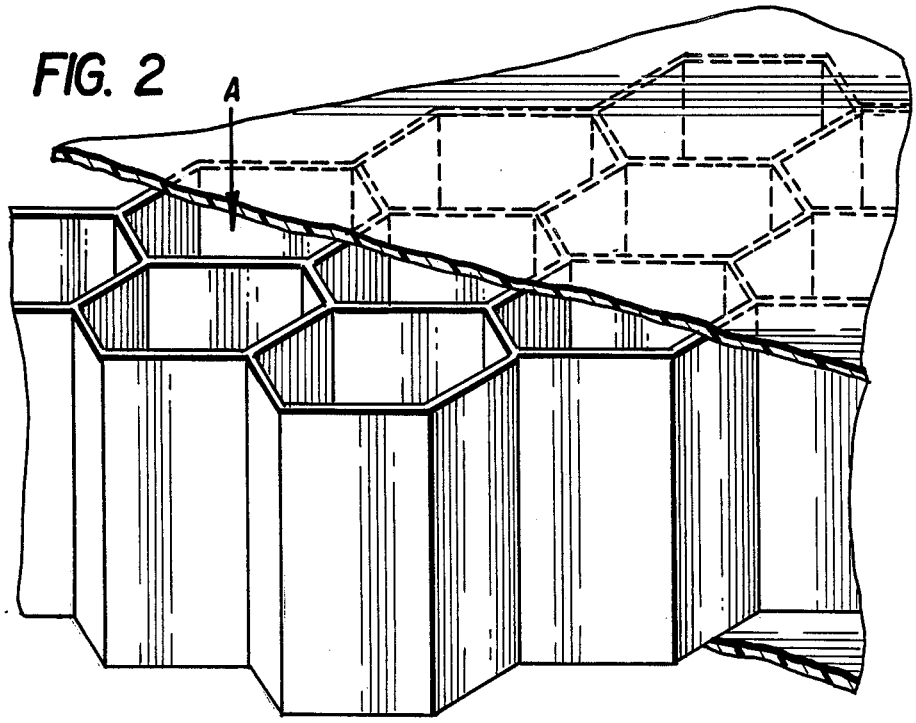
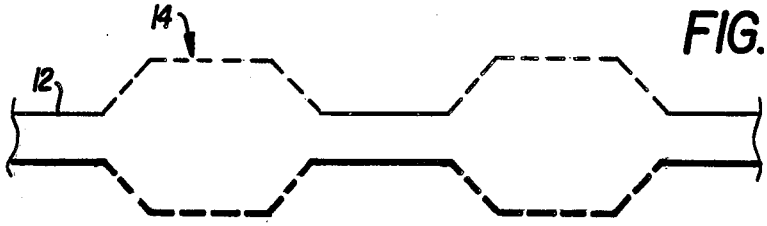
FIG. 3

EXPANDING INSULATING PAD

This invention relates to mattresses and in particular to a thermally insulating portable mattress assembly.

In applicant's Canadian Pat. No. 1,188,828 of June 11, 1985 a thermally insulating mattress is described as comprising a body support means which is substantially incompressible under body weight in a vertical direction and which is compressible in a horizontal direction to facilitate packing. A non-load bearing thermal insulant is included. In one embodiment, the body support means comprises a plurality of substantially equally spaced interlocking parallel strips. The spaces or cells between the strips are filled with various conventional thermal insulating materials.

Although a useful degree of horizontal compaction, i.e., about a factor of three, is achieved by the mattress according to our Canadian Patent, in view of the relatively large cells filled with heat insulant, it is still quite bulky and occupies a rather large packed volume.

It is an object of the present invention to provide a portable thermally insulating mattress assembly which can be stored in a relatively small space such as in an aircraft survival pack.

According to the invention, a thermally insulating portable mattress assembly is provided, comprising body support means which in an expanded position is substantially incompressible in a vertical direction under body weight under normal use conditions and which is compressible in a horizontal direction to a collapsed position to facilitate packing, wherein said body support means comprises a plurality of strips of a suitable flexible material arranged in rows, said strips being adhesively attached to adjacent strips at equally spaced staggered intervals to define in said expanded position a honeycomb-like structure of open-ended cells, said cells being sized in relation to the thickness of the body support means so as to balance the heat loss by radiation with the heat gain by conduction, and waterproof enclosure means for said body support means.

In the drawing which illustrates a preferred embodiment of the invention,

FIG. 1 is a plan view of the structure of the body support means of the mattress assembly according to the invention in the expanded position;

FIG. 2 is a perspective view of the body support means of the mattress assembly according to the invention; and FIG. 3 is a plan view of two adjacent strips of the body support means according to the invention.

As seen in the drawing, the mattress assembly according to the invention comprises a body support means indicated generally at 10 illustrated in the expanded position. The body support means 10 is substantially incompressible in a vertical direction, as indicated by the arrow A in FIG. 2, under body weight under normal use conditions. (i.e., A person lying quietly on the mattress would be supported. However, the structure may be damaged by someone walking on it). The body support means 10 is also compressible in a horizontal direction, as indicated by the arrow B in FIG. 1, to a collapsed position (not shown) to facilitate packing.

The body support means 10 comprises a plurality of strips 12 of a suitable flexible material arranged in rows which are folded at equally spaced intervals, as illustrated in phantom at 14 in FIG. 3. When two adjacent strips are joined as at 16, the folded portions mate to form a series of open-ended hexagonal cells 18, resulting in a honeycomb-like structure. It will be appreciated that the cells may be formed in other shapes such as circular and oval shapes by appropriate folding and manipulation of the strips during manufacture of the body support means. Thus, the strips 12 are adhesively attached to adjacent strips as at 16 at equally spaced staggered intervals, i.e., along the parallel sides 20 of the hexagonal cells 18. The nature of the adhesive will depend upon the application. In general, conventional adhesives used in the paper/honeycomb industry may be employed.

The suitable flexible strip material is preferably a paper or similar light-weight flexible material such as Tyvek®, a non-woven polyethylene. The thickness of the strip material may be in the range of 50 to 500 microns.

It will be appreciated that for hexagonally-shaped cells compaction of the body support means 10 to the collapsed position, the horizontal direction B must be perpendicular to the parellel sides 20 of the hexagonal cells 18. Otherwise, the honeycomb structure may pull apart.

For storage, the body support means is removed from the enclosure and compacted to a collapsed position to form a block approximately 70×5×5 cm which is easily stored and readily portable. This represents compaction by a factor of about 50 as opposed to about 3 in the case of the mattress described in our aforementioned Canadian Pat. No, 1,188,828. In use, the body support means is opened to an expanded position of a size of about 50×180×5 cm and slipped into a waterproof enclosure means (not shown), typically a plastic bag, such as a polythylene bag, to prevent entry of water or snow into the cells. Conventional bag closures such as twist ties may be used. Although primarily intended to be disposable and used only once, if the mattress is substantially undamaged, it may be repacked into its original volume and reused.

In order to provide effective heat insulation without including additional heat insulating material, (i.e., intrinsic heat insulation provided by air in the cells) heat loss by convection should be prevented and heat loss by radiation should be at about the same rate as that gained by conduction by the air in the cells. Heat conduction by the material of the cell walls should be negligible.

In order to achieve this balance, for a typical 5 cm thick mattress assembly used in conjunction with an arctic sleeping bag, a cell size of about 5 mm mean diameter is required. If the cell sizes are larger, the mattress must be thicker to achieve the same degree of heat insulation. Cell sizes greater than 15 mm mean diameter may permit convective heat transfer.

Thus, the mattress assembly according to the invention will have a heat insulating value comparable to that of most fibrous heat insulating materials of the same thickness, i.e. a thermal conductivety of 0.04 to 00.6 W/m K.

Potential uses for the mattress assembly according to the invention include survival packs for aircraft, automobiles, and marine craft. Hikers and mountaineers would also find it useful.

The embodiments of the invention in which an exclusive property or privilege is claimed are defined as follows:

1. A thermally insulating portable mattress structure consisting of body support means which in an expanded position is substantially incompressible in a vertical direction under body weight under normal use conditions and which is compressible in a horizontal direction to a collapsed position to facilitate packing, wherein said body support means comprises a plurality of strips of a suitable light-weight flexible material arranged in rows, said strips being adhesively attached to adjacent strips at equally spaced staggered intervals to define in said expanded position a honeycomb-like structure of open-ended cells, and wherein said cells are sized according to a cell height to cell width ratio of 3.5 to 10, and waterproof enclosure means for said body support means in the form of a plastic bag which surrounds said body support means.

2. A mattress assembly according to claim 1, wherein the cells are hexagonally-shaped.

3. A mattress assembly according to claim 2, wherein the suitable flexible material is paper.

4. A mattress assembly according to claim 3, wherein the mean diameter of the cells is 5 to 15 mm.

5. A mattress assembly according to claim 3, wherein the mean diameter of the cells is 5 to 15 mm and wherein the thickness of the suitable flexible material is 10 to 100 microns.

6. A mattress assembly according to claim 3, wherein the mean diameter of the cells is about 5 mm and wherein the thickness of the mattress assembly is about 5 cm.

7. A mattress assembly according to claim 1 wherein the plastic bag is a polyethylene bag.

* * * * *